US010813823B2

(12) United States Patent
Liang et al.

(10) Patent No.: US 10,813,823 B2
(45) Date of Patent: Oct. 27, 2020

(54) WALKER APPARATUS

(71) Applicant: Wistron Corp., New Taipei (TW)

(72) Inventors: Chen Yi Liang, New Taipei (TW); Cheng Hsing Liu, New Taipei (TW); Ming-Ju Hsieh, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 16/370,539

(22) Filed: Mar. 29, 2019

(65) Prior Publication Data

US 2020/0129368 A1 Apr. 30, 2020

(30) Foreign Application Priority Data

Oct. 29, 2018 (TW) ..... 107138119 A

(51) Int. Cl.
*A61H 3/04* (2006.01)

(52) U.S. Cl.
CPC ..... *A61H 3/04* (2013.01); *A61H 2201/0192* (2013.01)

(58) Field of Classification Search
CPC .. A61H 3/04; A61H 2201/0192; A61G 5/104; A61G 5/14; A61G 2200/34; A61G 2200/36; F16H 25/08; F16H 25/22; F16H 25/24
USPC ..... 280/87.041
See application file for complete search history.

(56) References Cited

U.S. PATENT DOCUMENTS

| | | | | |
|---|---|---|---|---|
| 3,596,298 | A * | 8/1971 | Durst, Jr. | A61G 7/1017 5/87.1 |
| 5,411,044 | A * | 5/1995 | Andolfi | A61G 7/1017 135/66 |
| 9,180,066 | B2 * | 11/2015 | Izard | A61H 3/008 |
| 9,414,987 | B2 * | 8/2016 | Bagheri | A61H 3/04 |
| 9,566,207 | B1 | 2/2017 | Ratliff | |
| 10,309,504 | B2 * | 6/2019 | Wang | F16H 25/186 |
| 2013/0221716 | A1 * | 8/2013 | Purwar | A61G 7/1073 297/311 |
| 2017/0209319 | A1 | 7/2017 | Fawcett et al. | |

FOREIGN PATENT DOCUMENTS

| | | | |
|---|---|---|---|
| CN | 1548020 | A | 11/2004 |
| CN | 101647745 | A | 2/2010 |
| CN | 101803988 | B | 6/2011 |
| CN | 105105990 | A | 12/2015 |
| CN | 102802583 | B | 3/2016 |
| CN | 207253429 | U | 4/2018 |
| JP | 2008-067849 | A | 3/2008 |
| TW | M509032 | U | 9/2015 |

* cited by examiner

*Primary Examiner* — John D Walters

(57) ABSTRACT

A walker apparatus is provided. The walker apparatus includes a base, a plurality of wheels, a connection bracket, a handle unit and an actuating unit. The wheels are connected to the base. The connection bracket pivots on the base. The handle unit is disposed on the connection bracket. The actuating unit is connected to the base and the connection bracket. The actuating unit moves the connection bracket between a getting-up orientation and a walking-assistance orientation relative to the base. The user can stand up from a sitting position using the walker apparatus without external assistance from other people.

17 Claims, 17 Drawing Sheets

WALKER APPARATUS

CROSS REFERENCE TO RELATED APPLICATIONS

This Application claims priority of Taiwan Patent Application No. 107138119, filed on Oct. 29, 2018, the entirety of which is incorporated by reference herein.

BACKGROUND OF THE INVENTION

Field of the Invention

The present invention relates to a walker apparatus, and in particular to a walker apparatus which helps the user to stand up from sitting.

Description of the Related Art

A conventional walker apparatus is utilized to assist the user in walking, and to prevent the user from falling. However, the user may lack strength in the waist and legs, and cannot stand up from a sitting position by himself A caregiver is often required to initially help the user to stand up from a sitting position, and then the user can grip the walker apparatus. For this reason, the conventional walker apparatus is inconvenient to the user, who still needs the assistance of a caregiver.

BRIEF SUMMARY OF THE INVENTION

In one embodiment, a walker apparatus is provided. The walker apparatus includes a base, a plurality of wheels, a connection bracket, a handle unit and an actuating unit. The wheels are connected to the base. The connection bracket pivots on the base. The handle unit is disposed on the connection bracket. The actuating unit is connected to the base and the connection bracket, wherein the actuating unit moves the connection bracket between a getting-up orientation and a walking-assistance orientation relative to the base.

Utilizing the walker apparatus of the embodiment of the invention, the user can stand up from a sitting position using the walker apparatus without external assistance from other people, and the user can move autonomously.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
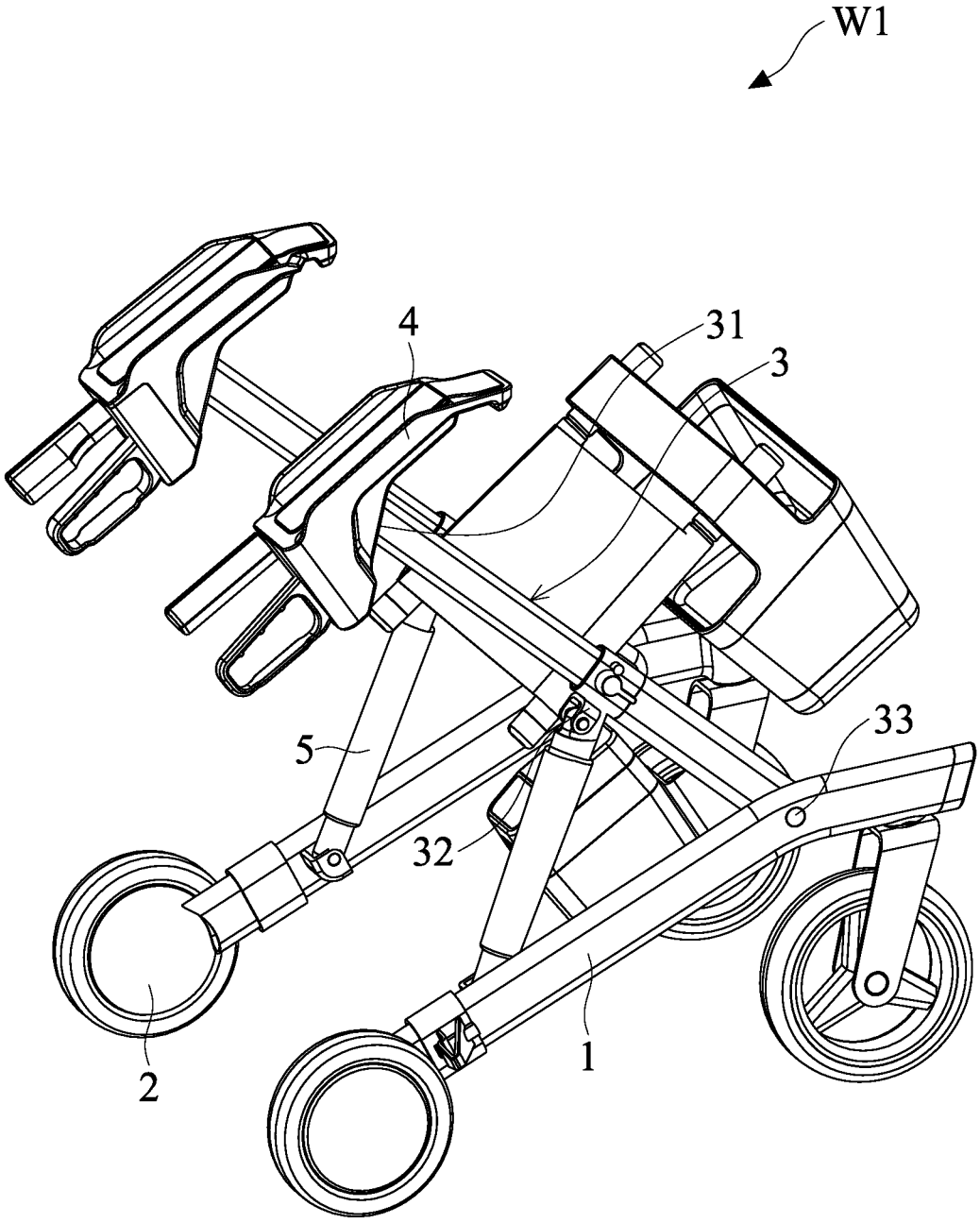
FIG. 1 is a perspective view of a walker apparatus of a first embodiment of the invention.

FIG. 1 is a perspective view of a walker apparatus W1 of a first embodiment of the invention. The walker apparatus W1 includes a base 1, a plurality of wheels 2, a connection bracket 3, a handle unit 4 and an actuating unit 5. The wheels 2 are connected to the base 1. The connection bracket 3 pivots on the base 1. The handle unit 4 is disposed on the connection bracket 3. The actuating unit 5 is connected to the base 1 and the connection bracket 3.

Figure 2A:
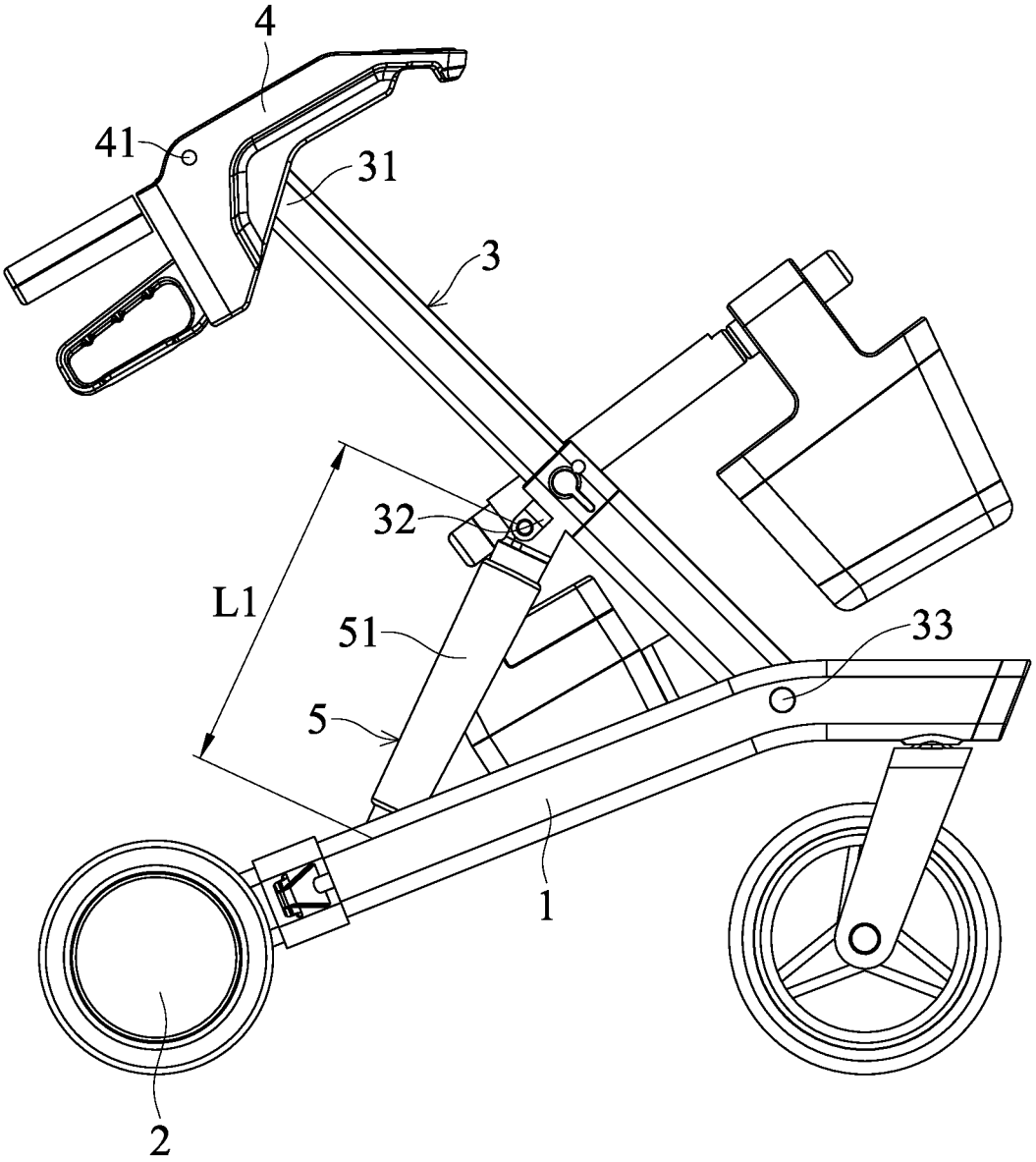
FIG. 2A shows the walker apparatus of the first embodiment of the invention, wherein the connection bracket is in a getting-up orientation.
Figure 2B:
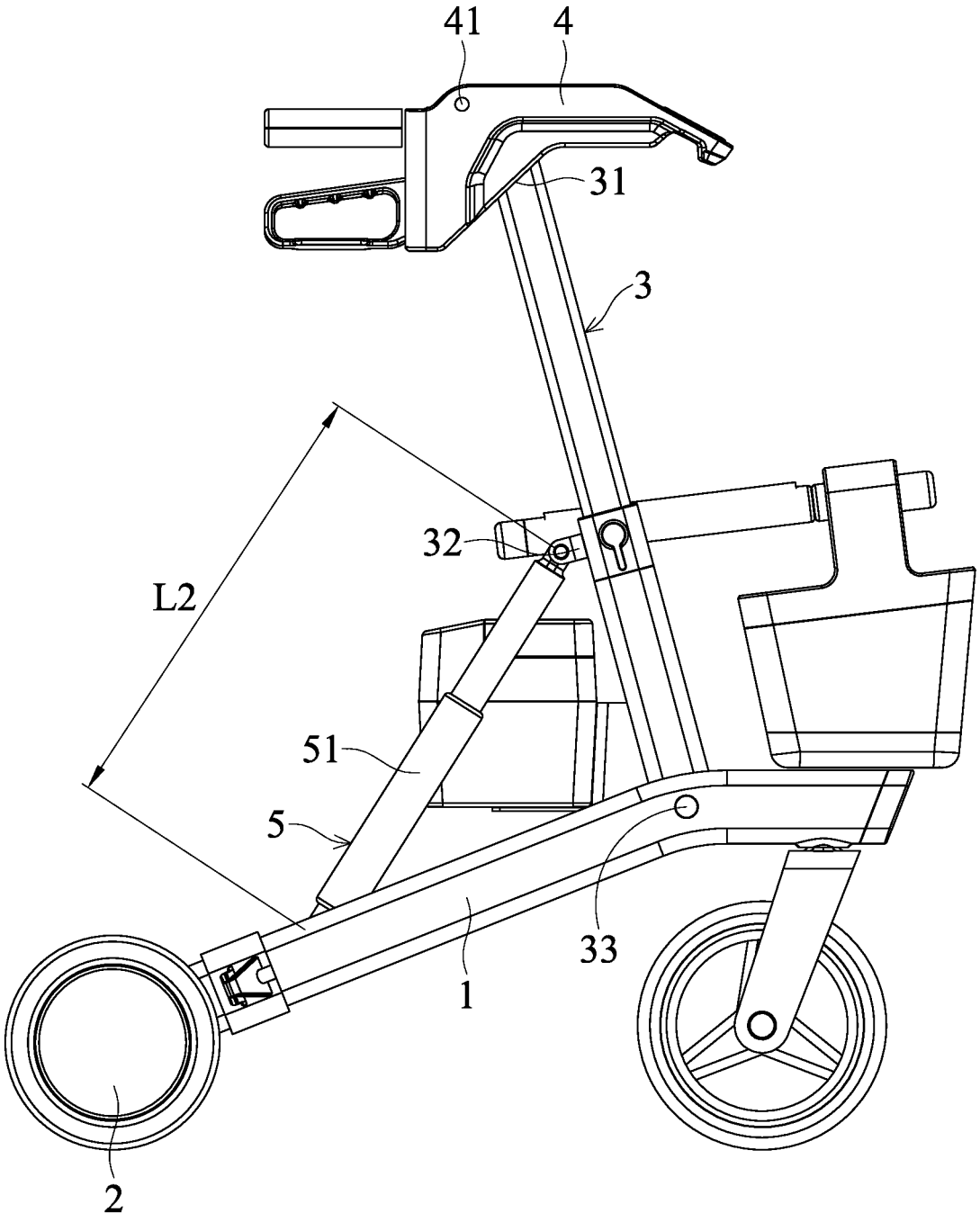
FIG. 2B shows the walker apparatus of the first embodiment of the invention, wherein the connection bracket is in a walking-assistance orientation.

FIG. 2A shows the walker apparatus of the first embodiment of the invention, wherein the connection bracket is in a getting-up orientation. FIG. 2B shows the walker apparatus of the first embodiment of the invention, wherein the connection bracket is in a walking-assistance orientation. With reference to FIGS. 2A and 2B, the actuating unit 5 moves the connection bracket 3 between the getting-up orientation (FIG. 2A) and a walking-assistance orientation (FIG. 2B) relative to the base 1.

Figure 3A:
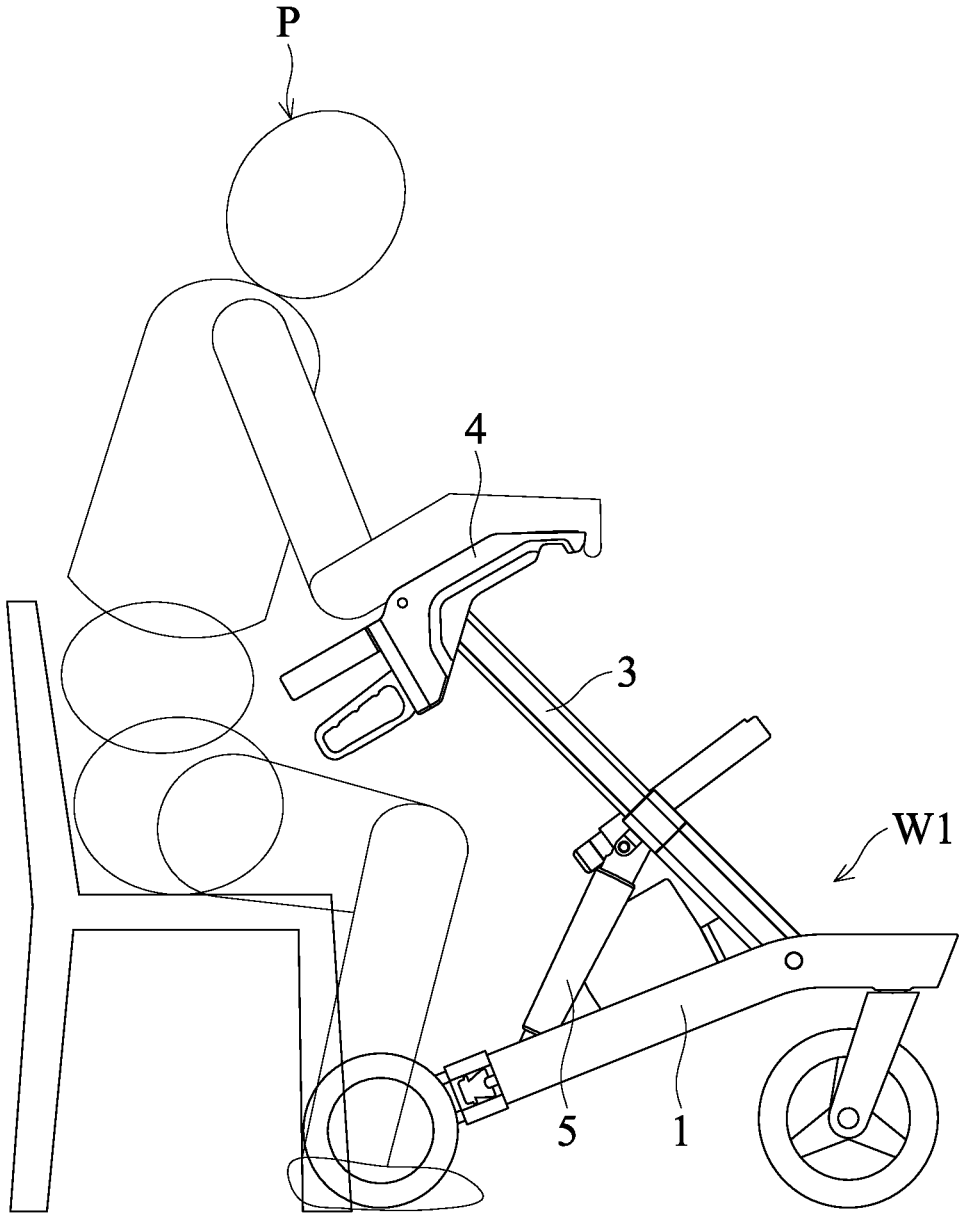
FIGS. 3A, 3B, 3C and 3D show the movement of the walker apparatus of the embodiment of the invention, wherein the user stands from sitting.
Figure 3B:
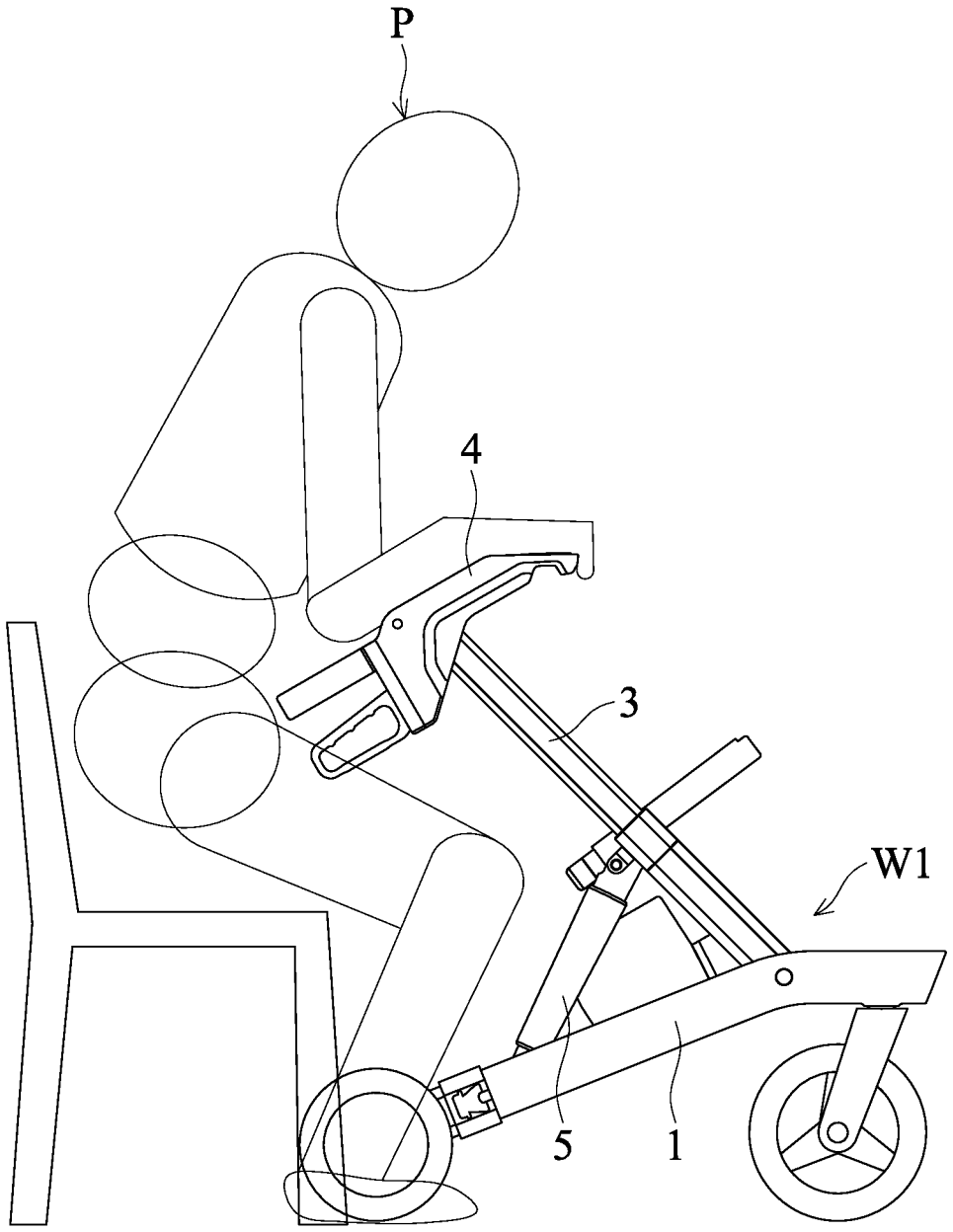
Figure 3C:
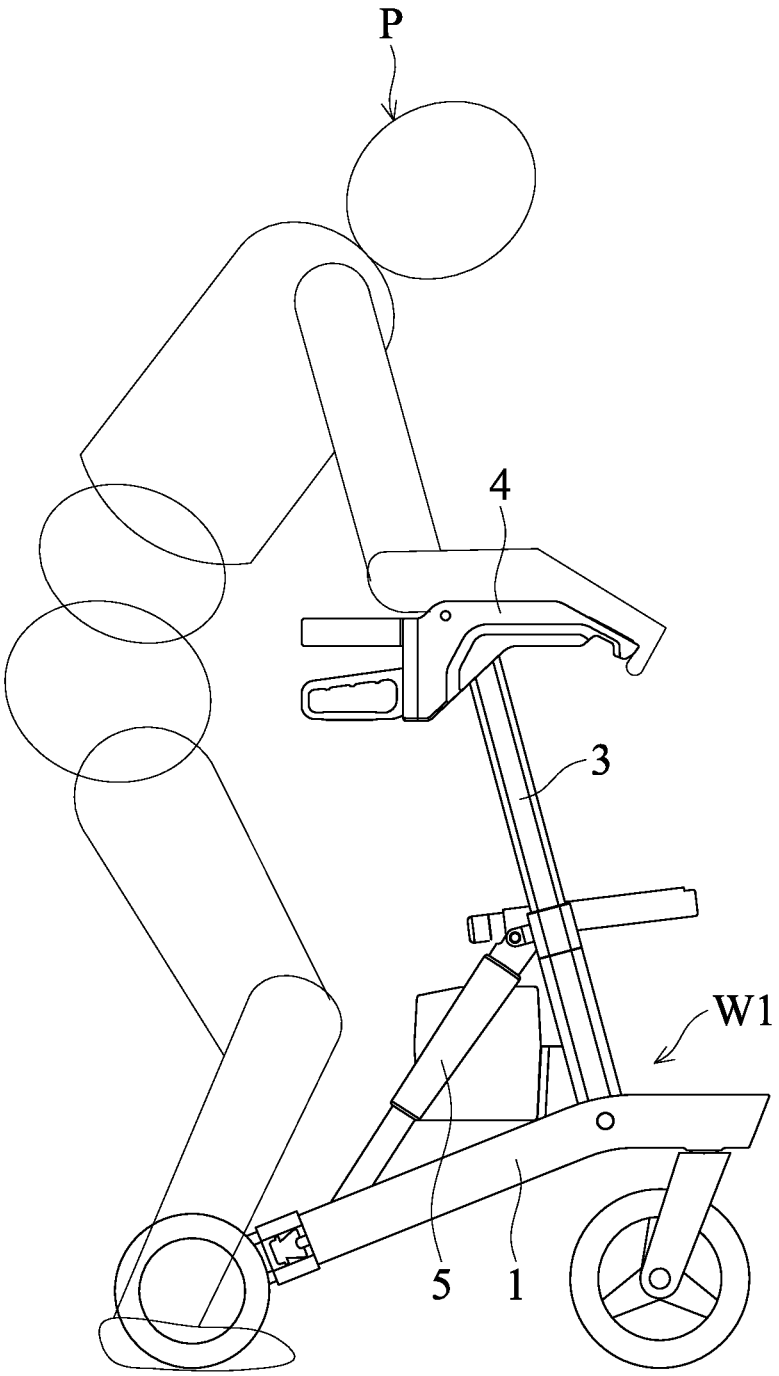
Figure 3D:
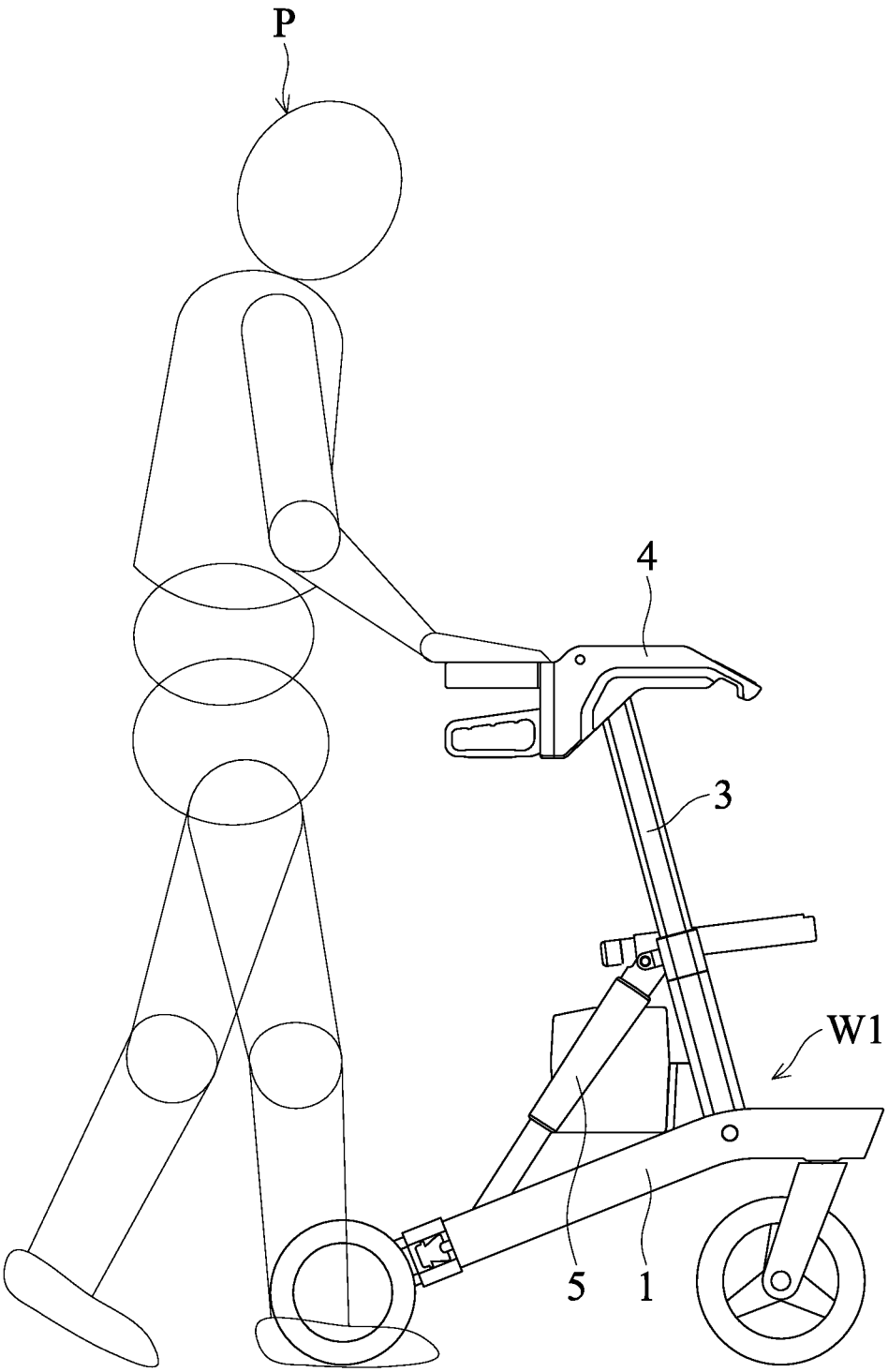

FIGS. 3A, 3B, 3C and 3D show the movement of the walker apparatus W1 of the embodiment of the invention. With reference to FIGS. 3A, 3B, 3C and 3D, utilizing the walker apparatus W1 of the embodiment of the invention, when the user P wants to stand up from sitting, the user P can lean against the handle unit 4 (FIG. 3A). Then, the actuating unit 5 rotates the connection bracket 3 from the getting-up orientation toward the walking-assistance orientation relative to the base 1, and the user P is therefore gradually raised (FIGS. 3A, 3B and 3C). Finally, the connection bracket 3 is in the walking-assistance orientation (FIG. 3D) relative to the base 1. The user P can walk under the assistance of the walker apparatus W1. Utilizing the walker apparatus W1 of the embodiment of the invention, the user P can stand up from a sitting position using the walker apparatus W1 without external assistance from other people, and the user P can move autonomously.

Figure 4A:
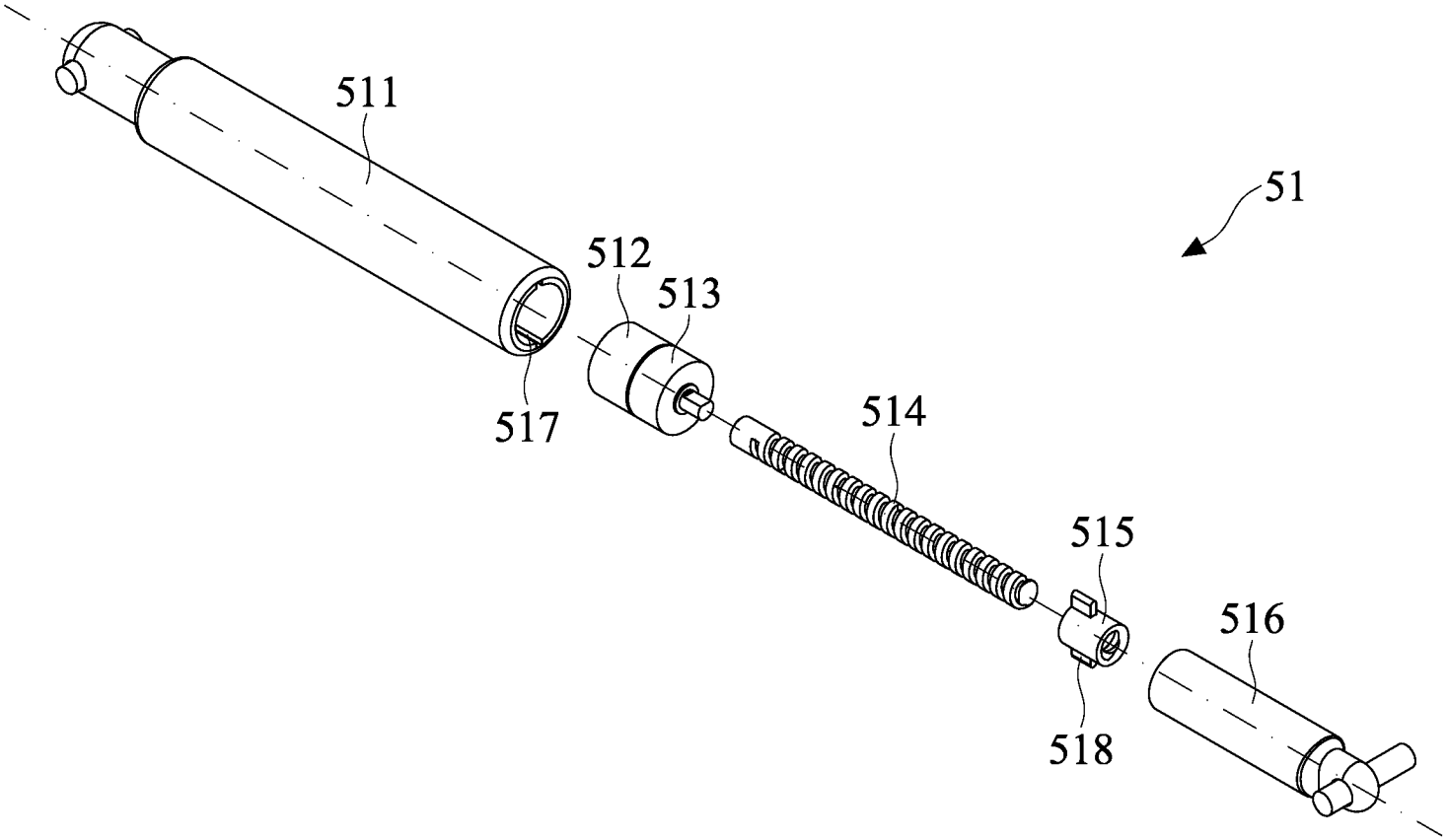
FIG. 4A shows the details of the actuating unit of an embodiment of the invention.

FIG. 4A shows the details of the actuating unit 5 of an embodiment of the invention. With reference to FIG. 4A, in one embodiment, the actuating unit 5 includes an electric pushrod 51. The electric pushrod 51 includes a pushrod housing 511, a motor 512, a reduction gear set 513, a thread rod 514, a sleeve 515 and a telescopic rod 516. The motor 512 is connected to the reduction gear set 513. The reduction gear set 513 is connected to the thread rod 514. The thread rod 514 is connected to the sleeve 515. The sleeve 515 is connected to the telescopic rod 516. The motor 512, the reduction gear set 513, the thread rod 514 and the sleeve 515 are disposed in the pushrod housing 511. The sleeve 515 is moved in the pushrod housing 511 to move the telescopic rod 516 relative to the pushrod housing 511, and the length of the actuating unit 5 therefore can be changed. Thus, the actuating unit 5 rotates the connection bracket 3 between the getting-up orientation and the walking-assistance orientation relative to the base 1.

With reference to FIG. 4A, in one embodiment, the pushrod housing 511 includes a pushrod slot 517. The sleeve 515 includes a sleeve protrusion 518. The sleeve protrusion 518 is inserted into the pushrod slot 517. The sleeve protrusion 518 is moved along the pushrod slot 517, and therefore the sleeve 515 can smoothly be moved in the pushrod housing 511.

Figure 4B:
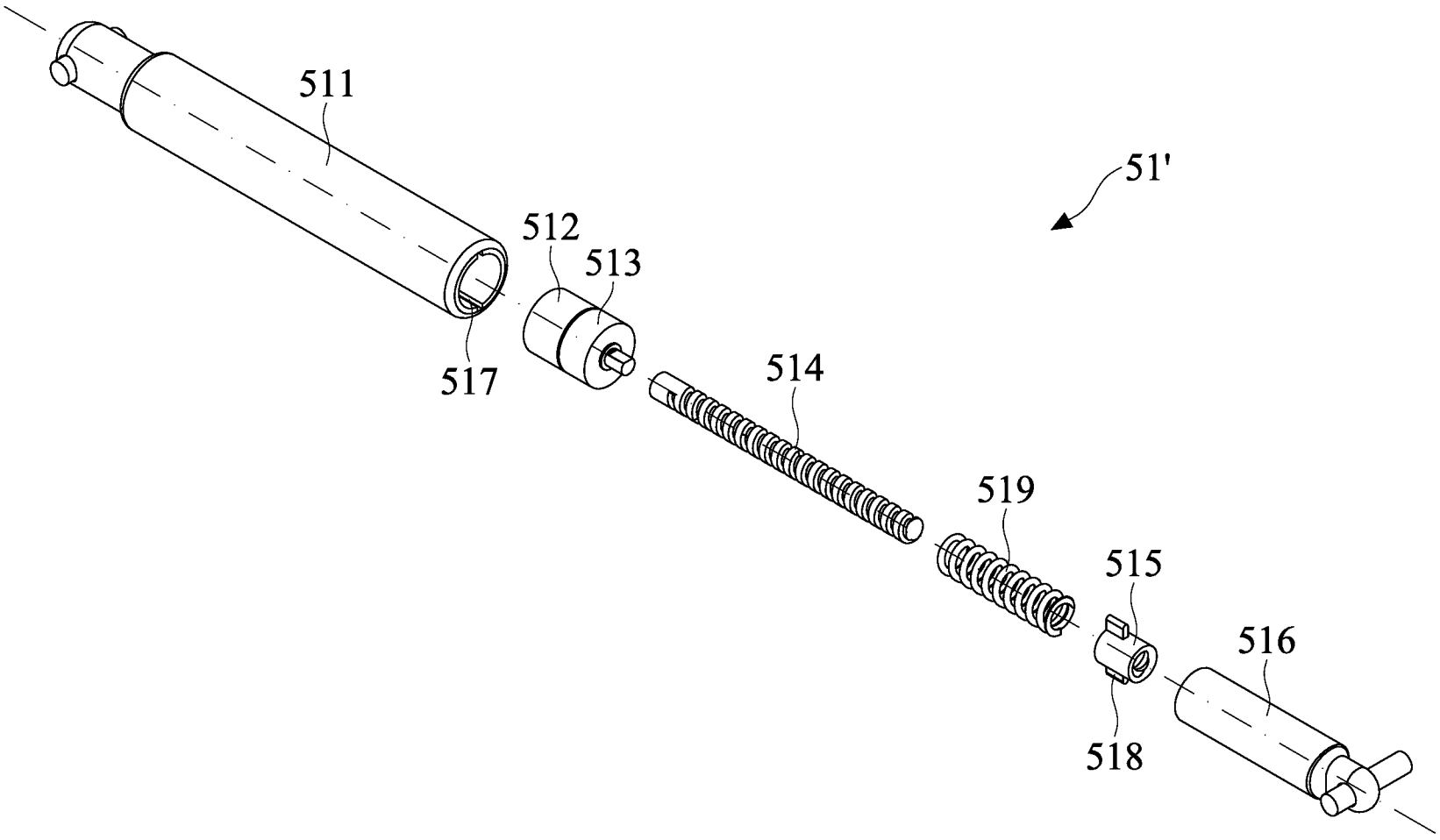
FIG. 4B shows the details of an actuating unit of another embodiment of the invention.

FIG. 4B shows the details of an actuating unit 5 of another embodiment of the invention. With reference to FIG. 4B, in one embodiment, the actuating unit 5 includes an electric pushrod 51'. In this embodiment, the electric pushrod 51' further includes a compression spring 519. The compression spring 519 is telescoped on the thread rod 514. One end of the compression spring 519 abuts the reduction gear set 513. The other end of the compression spring 519 abuts the sleeve 515. In this embodiment, the compression spring 519 applies an elastic force to the sleeve 515. Therefore, when the actuating unit 5 rotates the connection bracket 3 from the getting-up orientation to the walking-assistance orientation relative to the base 1, the elastic force of the compression spring 519 reduces the torque requirement of the motor 512.

With reference to FIGS. 1, 2A and 2B, in one embodiment, the connection bracket 3 includes a bracket pivot portion 33, a first bracket connection portion 31 and a second bracket connection portion 32. The connection bracket 3 pivots on the base 1 with the bracket pivot portion 33, the handle unit 4 is disposed on the first bracket connection portion 31. The actuating unit 5 is connected to the base 1 and the second bracket connection portion 32. The second bracket connection portion 32 is located between the first bracket connection portion 31 and the bracket pivot portion 33.

In one embodiment, one end of the electric pushrod 51 connects to the base 1. The other end of the electric pushrod 51 connects to the second bracket connection portion 32. When the electric pushrod 51 has a first pushrod length L1, the connection bracket 3 is in the getting-up orientation (FIG. 2A). When the electric pushrod 51 has a second pushrod length L2, the connection bracket 3 is in the walking-assistance orientation (FIG. 2B). In this embodiment, the first pushrod length L1 is shorter than the second pushrod length L2.

In one embodiment, the connection bracket 3 pivots on the base 1 with the bracket pivot portion 33, the actuating unit 5 pushes the connection bracket 3 to be pivoted between the getting-up orientation and the walking-assistance orientation around the bracket pivot portion 33. Therefore, the actuating unit 5 rotates the connection bracket 3 between the getting-up orientation and the walking-assistance orientation relative to the base 1.

In one embodiment, the handle unit 4 has a switch unit 41, and the switch unit 41 is coupled to the actuating unit 5. The actuating unit 5 is switched by the switch unit 41 to rotate the connection bracket 3 between the getting-up orientation and the walking-assistance orientation relative to the base 1. The switch unit 41 can includes a sensor (pressure sensor, capacitive sensor, light sensing sensor, or magnetic sensor), a limit switch or a temperature difference switch.

Figure 5A:
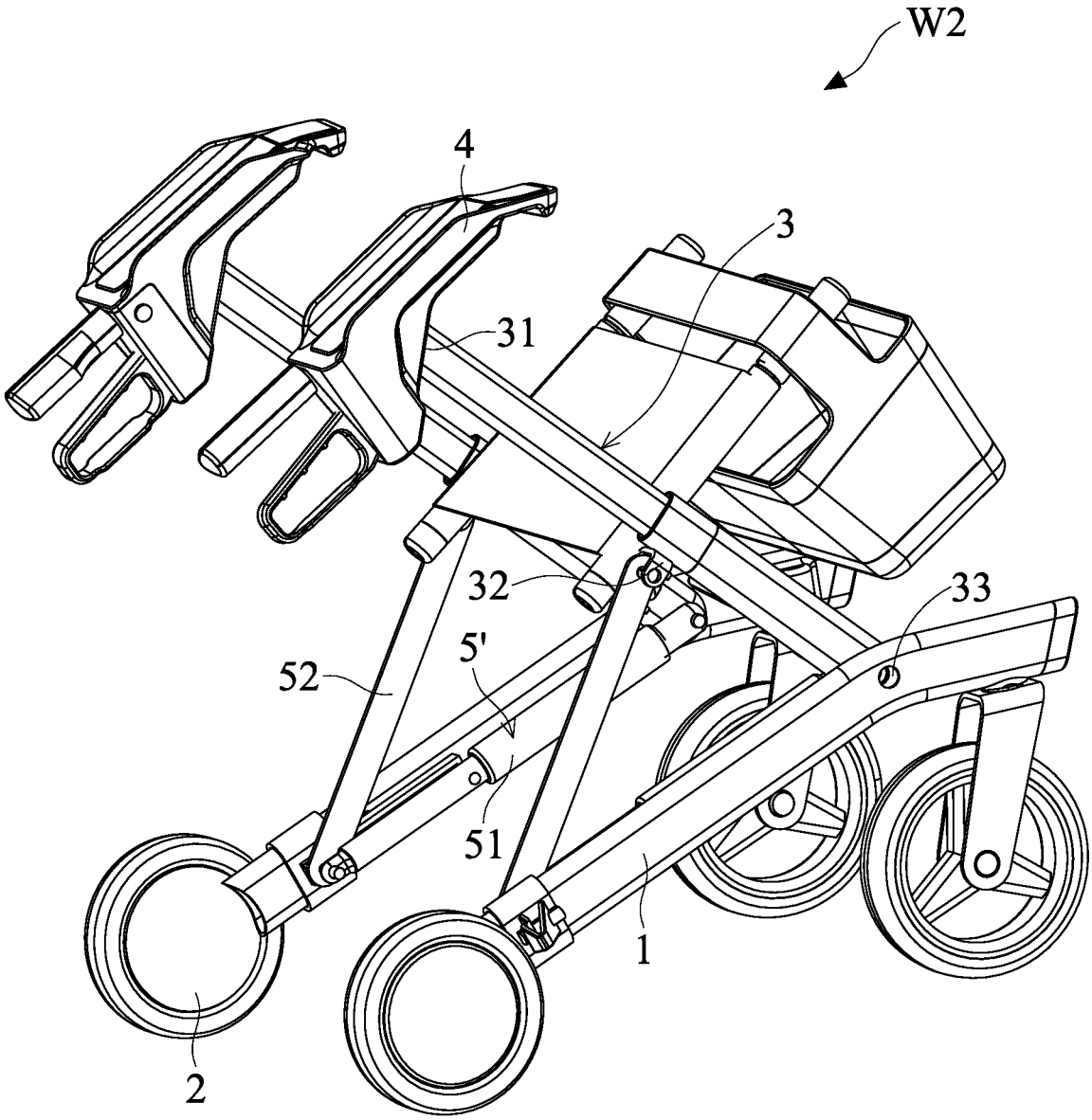
FIG. 5A is a perspective view of the walker apparatus of a second embodiment of the invention.
Figure 5B:
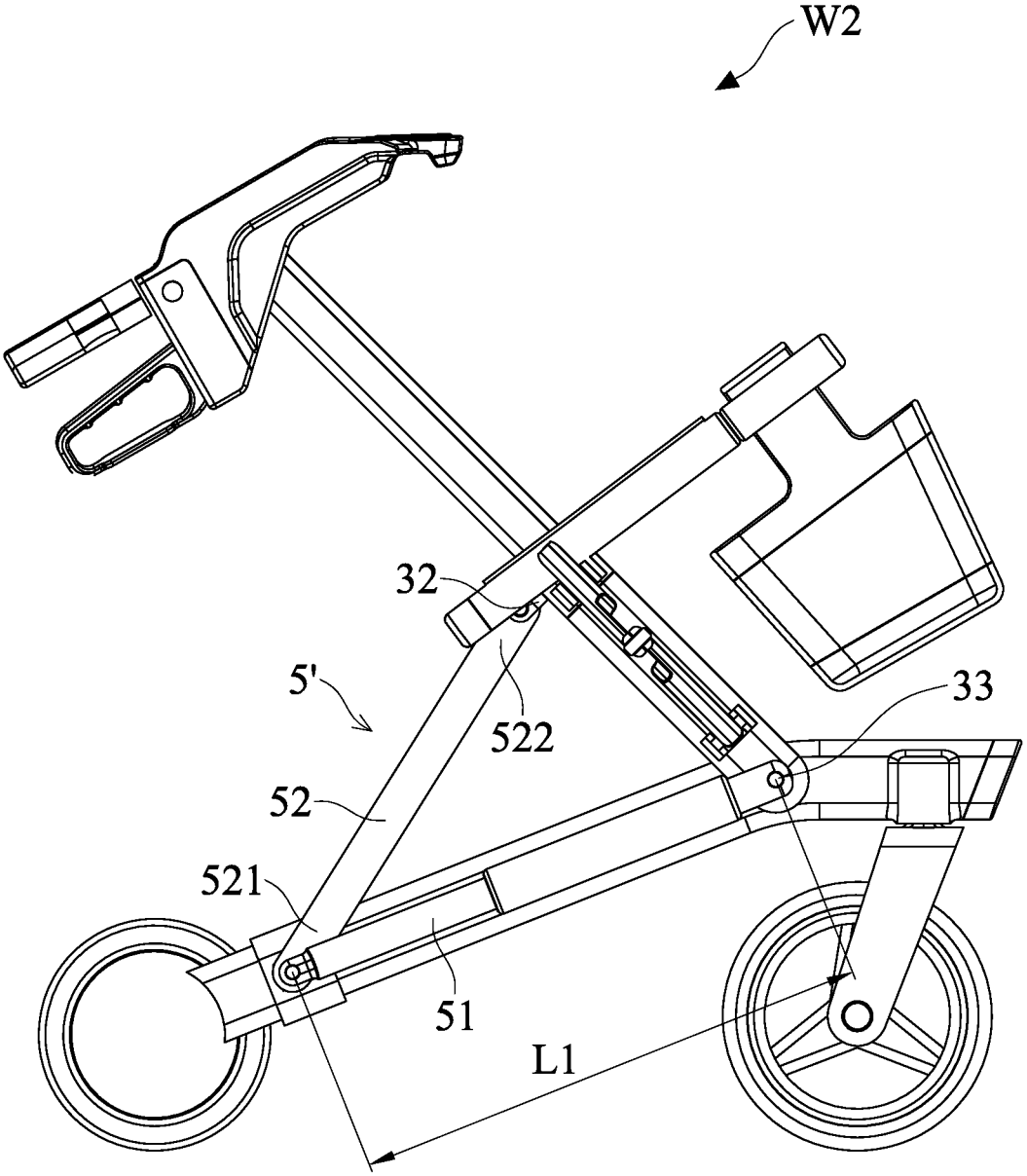
FIG. 5B shows the walker apparatus of the second embodiment of the invention, wherein the connection bracket is in the getting-up orientation.
Figure 5C:
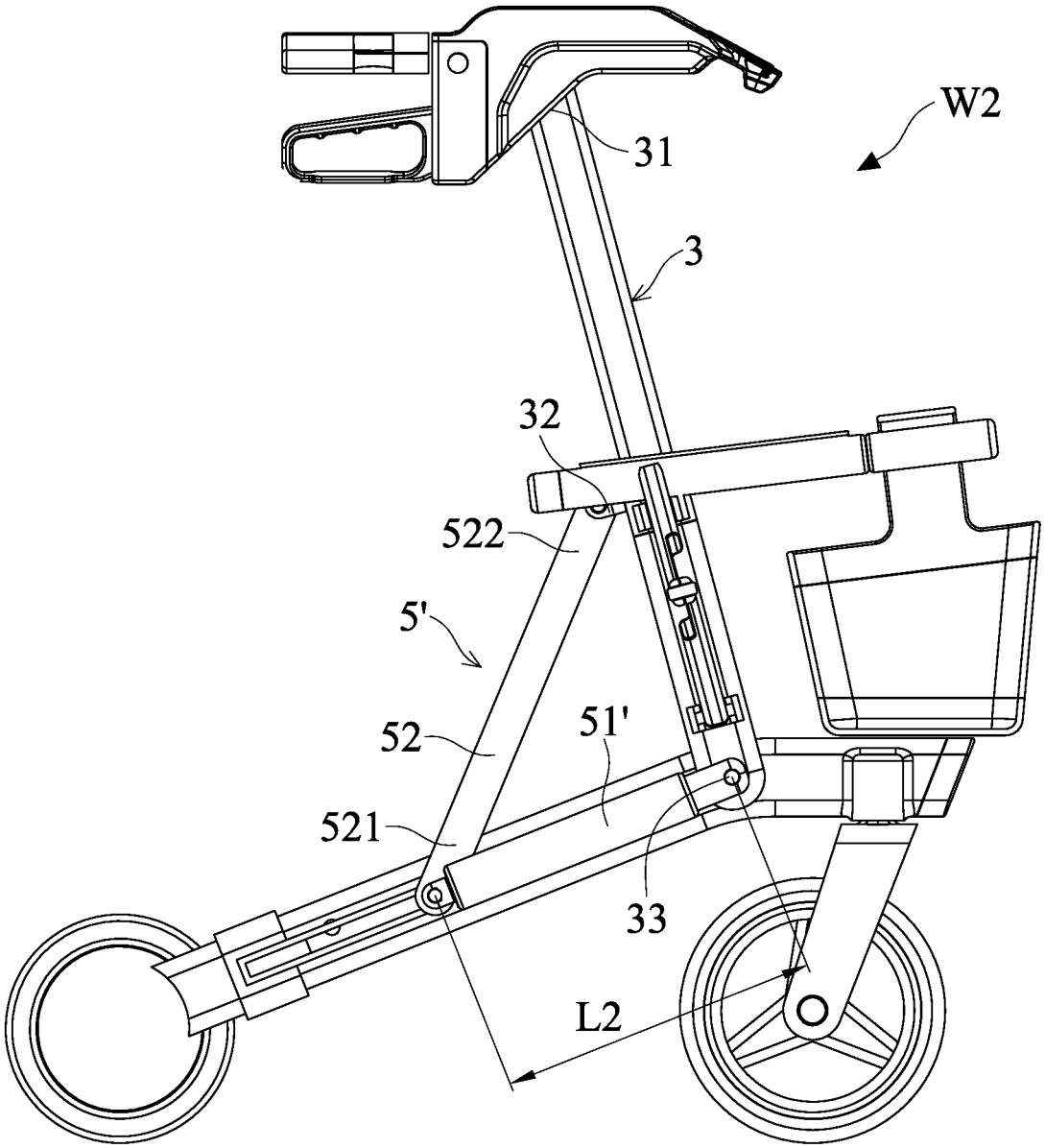
FIG. 5C shows the walker apparatus of the second embodiment of the invention, wherein the connection bracket is in the walking-assistance orientation.

FIG. 5A is a perspective view of the walker apparatus W2 of a second embodiment of the invention. FIG. 5B shows the walker apparatus W2 of the second embodiment of the invention, wherein the connection bracket is in the getting-up orientation. FIG. 5C shows the walker apparatus W2 of the second embodiment of the invention, wherein the connection bracket is in the walking-assistance orientation. With reference to FIGS. 5A, 5B and 5C, in one embodiment, the actuating unit 5' includes an electric pushrod 51 and a linkage 52. One end of the electric pushrod 51 is connected to the base 1. The other end of the electric pushrod 51 is connected to a first linkage end 521 of the linkage 52, and a second linkage end 522 of the linkage 52 is connected to the second bracket connection portion 32. With reference to FIGS. 5B and 5C, when the electric pushrod 51 has a first pushrod length L1, the connection bracket 3 is in the getting-up orientation (FIG. 5B). When the electric pushrod 51 has a second pushrod length L2, the connection bracket 3 is in the walking-assistance orientation (FIG. 5C). In this embodiment, the first pushrod length L1 is longer than the second pushrod length L2.

In one embodiment, the connection bracket 3 pivots on the base 1 with the bracket pivot portion 33, the actuating unit 5' (the electric pushrod 51 and the linkage 52) pushes the connection bracket 3 to be pivoted between the getting-up orientation and the walking-assistance orientation around the bracket pivot portion 33. Therefore, the actuating unit 5' rotates the connection bracket 3 between the getting-up orientation and the walking-assistance orientation relative to the base 1.

Figure 6A:
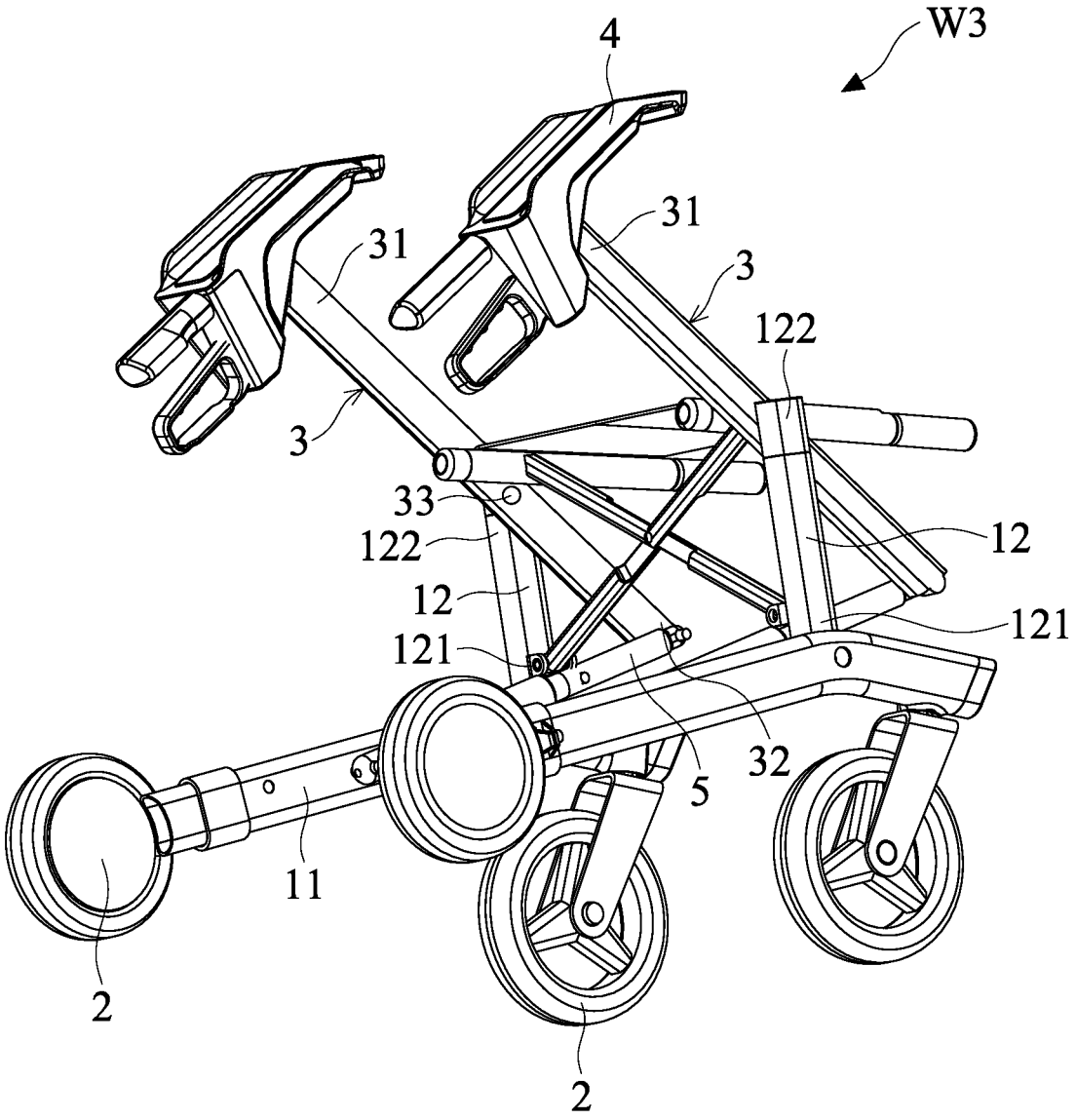
FIG. 6A is a perspective view of the walker apparatus of a third embodiment of the invention.
Figure 6B:
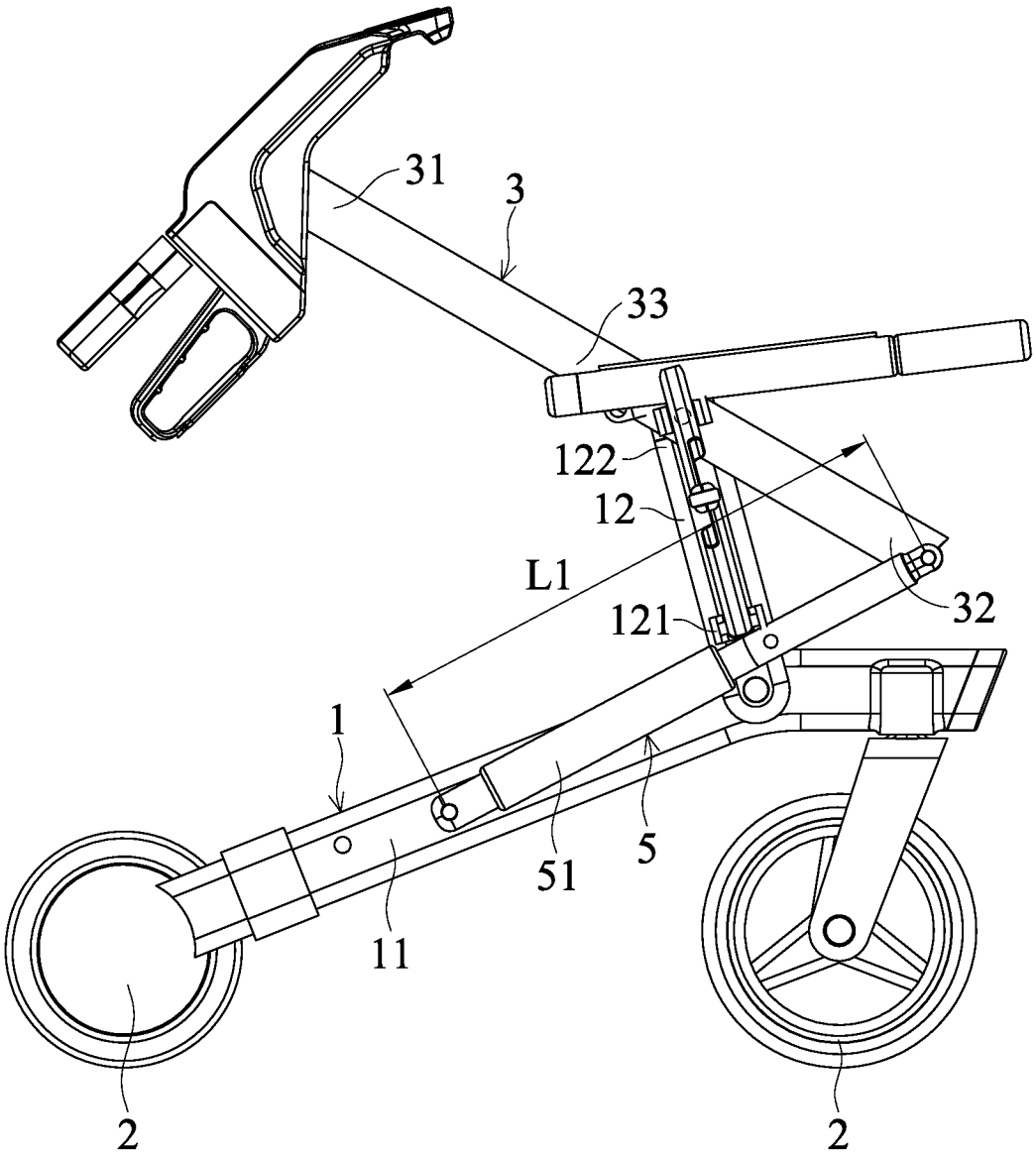
FIG. 6B shows the walker apparatus of the third embodiment of the invention, wherein the connection bracket is in the getting-up orientation.
Figure 6C:
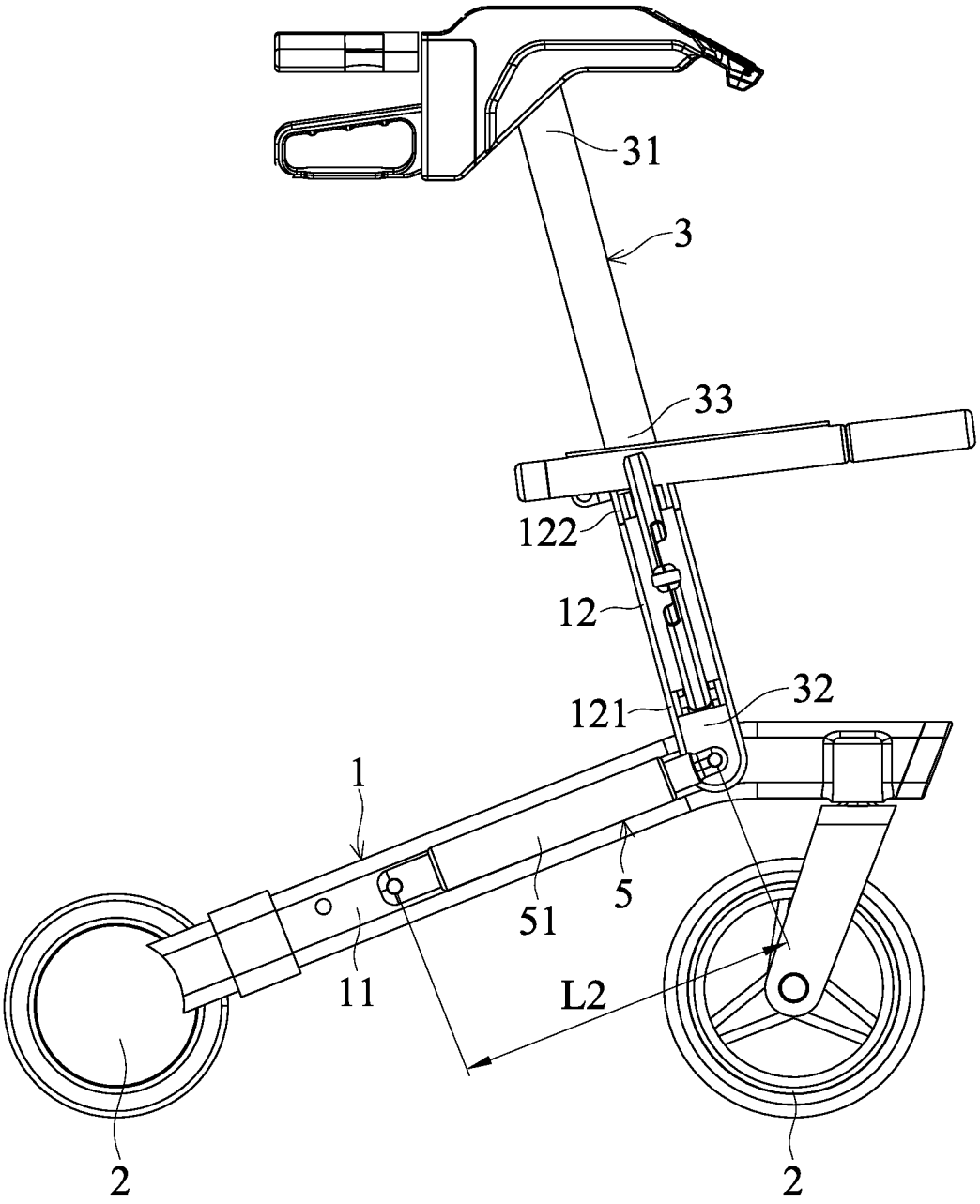
FIG. 6C shows the walker apparatus of the third embodiment of the invention, wherein the connection bracket is in the walking-assistance orientation.

FIG. 6A is a perspective view of the walker apparatus W3 of a third embodiment of the invention. FIG. 6B shows the walker apparatus W3 of the third embodiment of the invention, wherein the connection bracket is in the getting-up orientation. FIG. 6C shows the walker apparatus W3 of the third embodiment of the invention, wherein the connection bracket is in the walking-assistance orientation. With reference to FIGS. 6A, 6B and 6C, in one embodiment, the connection bracket 3 includes a bracket pivot portion 33, a first bracket connection portion 31 and a second bracket connection portion 32. The connection bracket 3 pivots on the base 1 with the bracket pivot portion 33, the handle unit 4 is disposed on the first bracket connection portion 31. The actuating unit 5 is connected to the base 1 and the second bracket connection portion 32. The bracket pivot portion 33 is located between the first bracket connection portion 31 and the second bracket connection portion 32.

With reference to FIGS. 6A, 6B and 6C, in one embodiment, the base 1 includes a base bracket 11 and an extending bracket 12. The extending bracket 12 is connected to the base bracket 11. The wheels 2 are connected to the base bracket 11. A fastening end 121 of the extending bracket 12 is connected to the base bracket 11. A free end 122 of the extending bracket 12 pivots on the connection bracket 3, and the free end 122 is higher than the fastening 121 end relative to the wheels 2.

With reference to FIGS. 6A, 6B and 6C, in one embodiment, the actuating unit 5 includes an electric pushrod 51. One end of the electric pushrod 51 connects to the base bracket 11, and the other end of the electric pushrod 51 connects to the second bracket connection portion 32. When the electric pushrod 51 has a first pushrod length L1, the connection bracket 3 is in the getting-up orientation (FIG. 6B). When the electric pushrod 51 has a second pushrod length L2, the connection bracket 3 is in the walking-assistance orientation (FIG. 6C). In this embodiment, the first pushrod length L1 is longer than the second pushrod length L2.

In this embodiment, the connection bracket 3 pivots on the extending bracket 12 of the base 1 with the bracket pivot portion 33, the actuating unit 5 pushes the connection bracket 3 to be pivoted between the getting-up orientation and the walking-assistance orientation around the bracket pivot portion 33. Therefore, the actuating unit 5 rotates the connection bracket 3 between the getting-up orientation and the walking-assistance orientation relative to the base 1.

Figure 7:
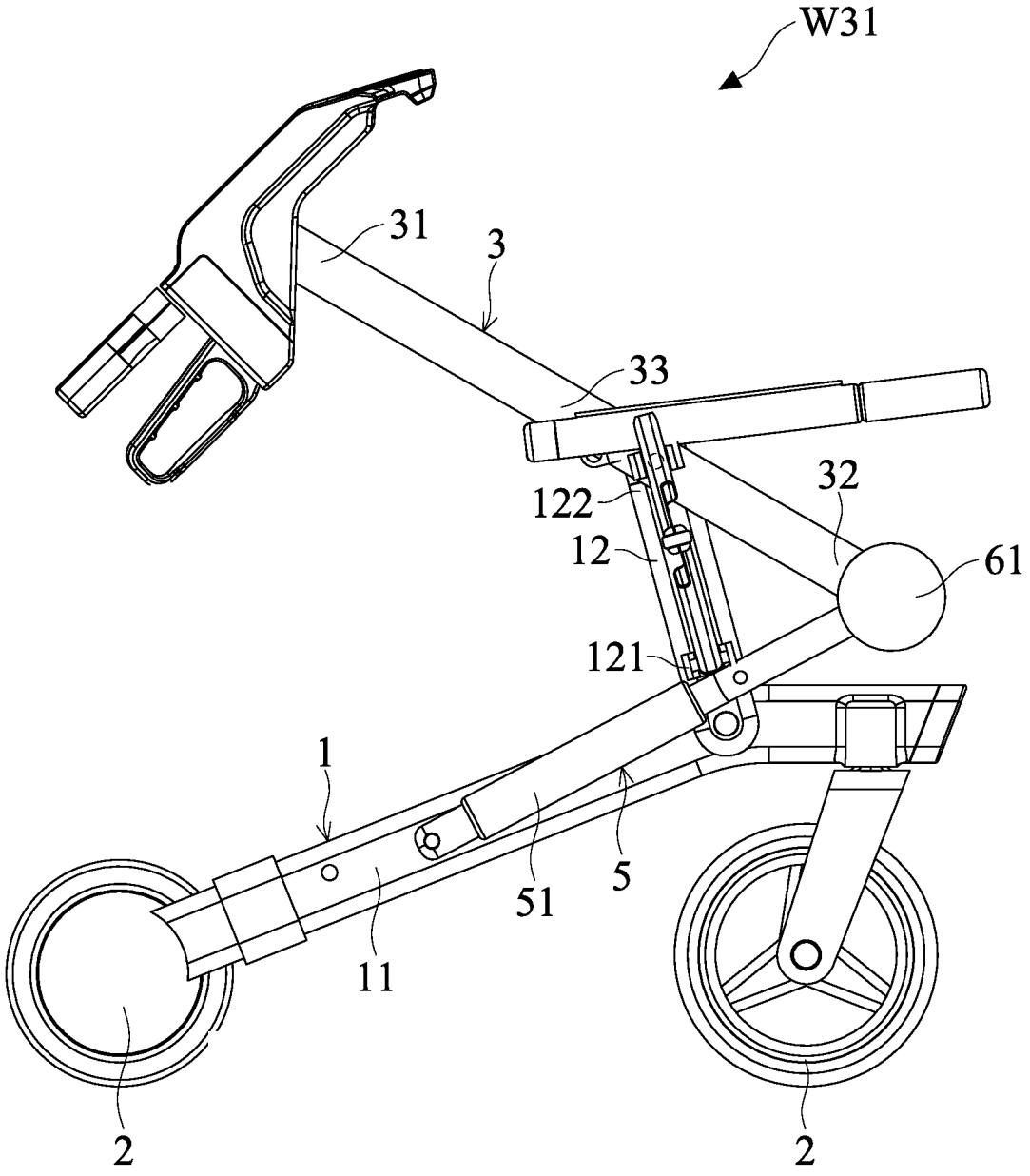
FIG. 7 shows a modified example of the walker apparatus of the third embodiment of the invention.

FIG. 7 shows a modified example of the walker apparatus of the third embodiment of the invention. In this embodiment, the walker apparatus W31 further includes a counterweight 61, and the counterweight 61 is disposed on the second bracket connection portion 32. In this embodiment, the counterweight 61 provides weight. Therefore, when the actuating unit 5 rotates the connection bracket 3 from the getting-up orientation to the walking-assistance orientation relative to the base 1, the weight of the counterweight 61 reduces the torque requirement of the motor 512.

Figure 8:
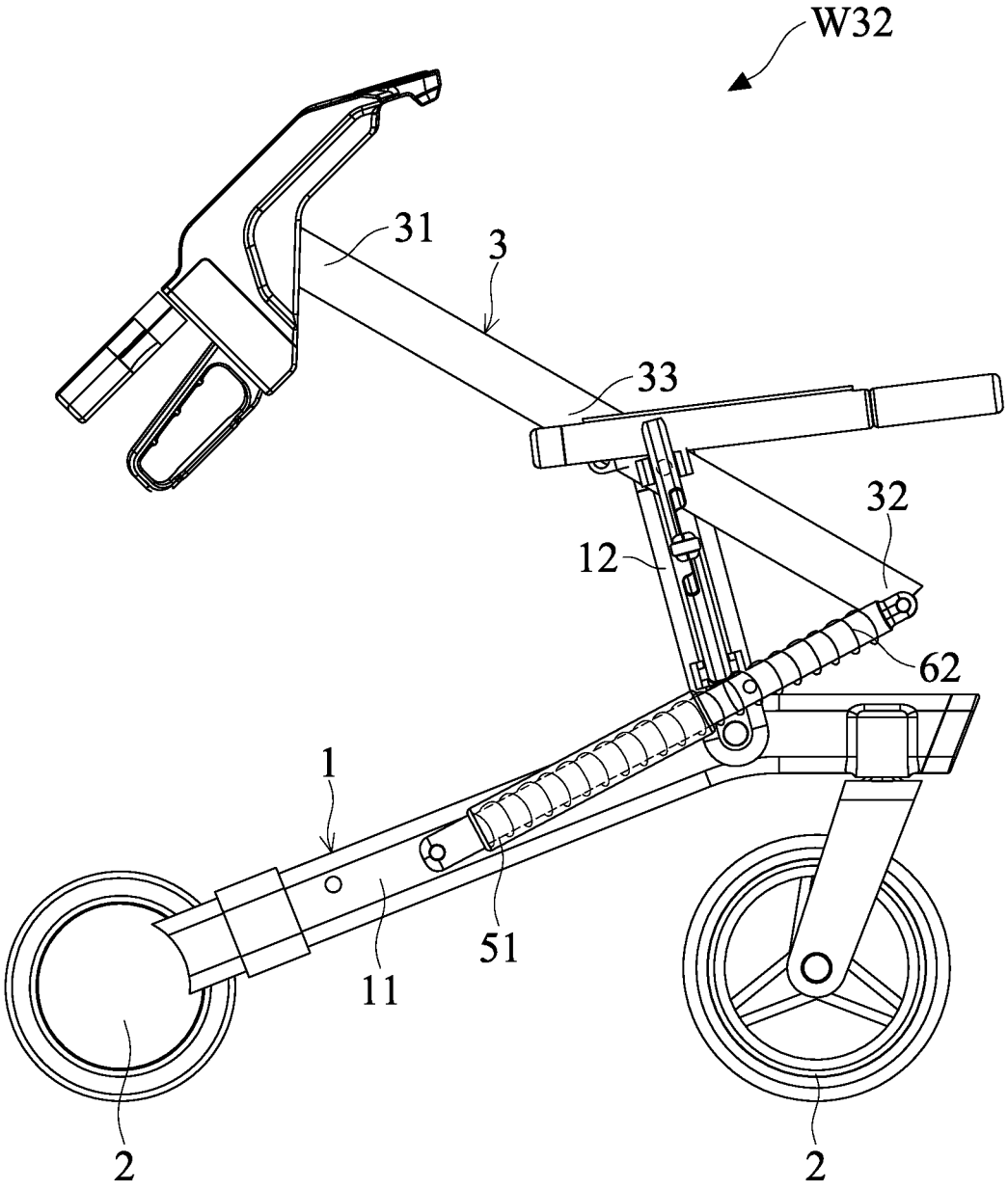
FIG. 8 shows another modified example of the walker apparatus of the third embodiment of the invention.

FIG. 8 shows another modified example of the walker apparatus of the third embodiment of the invention. In this embodiment, the walker apparatus W32 further includes a labor saving spring 62. The labor saving spring 62 is telescoped on the actuating unit 5. More specifically, the labor saving spring 62 is telescoped on the electric pushrod 51. One end of the labor saving spring 62 is connected to the base bracket 11, and the other end of the labor saving spring 62 is connected to the second bracket connection portion 32. In this embodiment, the labor saving spring 62 provides an elastic force. Therefore, when the actuating unit 5 rotates the connection bracket 3 from the getting-up orientation to the walking-assistance orientation relative to the base 1, the elastic force of the labor saving spring 62 reduces the torque requirement of the motor 512.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A walker apparatus, comprising:

a base;

a plurality of wheels, connected to the base;

a connection bracket, pivoting on the base;

a handle unit, disposed on the connection bracket; and an actuating unit, connected to the base and the connection bracket, wherein the actuating unit moves the connection bracket between a getting-up orientation and a walking-assistance orientation relative to the base, wherein the actuating unit comprises an electric pushrod, wherein the electric pushrod comprises a pushrod housing, a motor, a reduction gear set, a thread rod, a sleeve and a telescopic rod, the motor is connected to the reduction gear set, the reduction gear set is connected to the thread rod, the thread rod is connected to the sleeve, the sleeve is connected to the telescopic rod, the motor, the reduction gear set, and the thread rod, and the sleeve is disposed in the pushrod housing, and the sleeve is moved in the pushrod housing, wherein the pushrod housing comprises a pushrod slot, the sleeve comprises a sleeve protrusion, the sleeve protrusion is inserted into the pushrod slot, and the sleeve protrusion is moved along the pushrod slot.

2. The walker apparatus as claimed in claim 1, wherein the connection bracket comprises a bracket pivot portion, the connection bracket pivots on the base with the bracket pivot portion, the actuating unit pushes the connection bracket to be pivoted between the getting-up orientation and the walking-assistance orientation around the bracket pivot portion.

3. The walker apparatus as claimed in claim 2, wherein the connection bracket further comprises a first bracket connection portion and a second bracket connection portion, the handle unit is disposed on the first bracket connection portion, and the actuating unit connects the base to the second bracket connection portion.

4. The walker apparatus as claimed in claim 3, wherein one end of the electric pushrod connects to the base, the other end of the electric pushrod connects to the second bracket connection portion, and when the electric pushrod has a first pushrod length, the connection bracket is in the getting-up orientation, and when the electric pushrod has a second pushrod length, the connection bracket is in the walking-assistance orientation.

5. The walker apparatus as claimed in claim 4, wherein the second bracket connection portion is located between the first bracket connection portion and the bracket pivot portion, and the first pushrod length is shorter than the second pushrod length.

6. The walker apparatus as claimed in claim 3, wherein the actuating unit comprises a linkage, one end of the electric pushrod is connected to the base, the other end of the electric pushrod is connected to a first linkage end of the linkage, a second linkage end of the linkage is connected to the second bracket connection portion, and when the electric pushrod has a first pushrod length, the connection bracket is in the getting-up orientation, and when the electric pushrod has a second pushrod length, the connection bracket is in the walking-assistance orientation.

7. The walker apparatus as claimed in claim 6, wherein the second bracket connection portion is located between the first bracket connection portion and the bracket pivot portion, and the first pushrod length is longer than the second pushrod length.

8. The walker apparatus as claimed in claim 3, wherein the base comprises a base bracket and an extending bracket, the extending bracket is connected to the base bracket, the wheels are connected to the base bracket, a fastening end of the extending bracket is connected to the base bracket, a free end of the extending bracket pivots on the connection bracket, and the free end is higher than the fastening end relative to the wheels.

9. The walker apparatus as claimed in claim 8, wherein one end of the electric pushrod connects to the base bracket, the other end of the electric pushrod connects to the second bracket connection portion, the connection bracket pivots on the extending bracket of the base with the bracket pivot portion, and when the electric pushrod has a first pushrod length, the connection bracket is in the getting-up orientation, and when the electric pushrod has a second pushrod length, the connection bracket is in the walking-assistance orientation.

10. The walker apparatus as claimed in claim 9, wherein the bracket pivot portion is located between the first bracket connection portion and the second bracket connection portion, and the first pushrod length is longer than the second pushrod length.

11. The walker apparatus as claimed in claim 3, further comprising a counterweight, and the counterweight is disposed on the second bracket connection portion.

12. The walker apparatus as claimed in claim 3, further comprising a labor saving spring, the labor saving spring is telescoped on the actuating unit, one end of the labor saving spring is connected to the base, and the other end of the labor saving spring is connected to the second bracket connection portion.

13. A walker apparatus, comprising:

a base;

a plurality of wheels, connected to the base;

a connection bracket, pivoting on the base;

a handle unit, disposed on the connection bracket; and an actuating unit, connected to the base and the connection bracket, wherein the actuating unit moves the connection bracket between a getting-up orientation and a walking-assistance orientation relative to the base, wherein the actuating unit comprises an electric pushrod, wherein the electric pushrod comprises a pushrod housing, a motor, a reduction gear set, a thread rod, a sleeve and a telescopic rod, the motor is connected to the reduction gear set, the reduction gear set is connected to the thread rod, the thread rod is connected to the sleeve, the sleeve is connected to the telescopic rod, the motor, the reduction gear set, and the thread rod, and the sleeve is disposed in the pushrod housing, and the sleeve is moved in the pushrod housing, wherein the electric pushrod further comprises a compression spring, the compression spring is telescoped on the thread rod, one end of the compression spring abuts the reduction gear set, and the other end of the compression spring abuts the sleeve.

14. The walker apparatus as claimed in claim 13, wherein the connection bracket comprises a bracket pivot portion, the connection bracket pivots on the base with the bracket pivot portion, the actuating unit pushes the connection bracket to be pivoted between the getting-up orientation and the walking-assistance orientation around the bracket pivot portion.

15. The walker apparatus as claimed in claim 14, wherein the connection bracket further comprises a first bracket connection portion and a second bracket connection portion, the handle unit is disposed on the first bracket connection portion, and the actuating unit connects the base to the second bracket connection portion.

16. The walker apparatus as claimed in claim 15, wherein one end of the electric pushrod connects to the base, the other end of the electric pushrod connects to the second bracket connection portion, and when the electric pushrod has a first pushrod length, the connection bracket is in the getting-up orientation, and when the electric pushrod has a second pushrod length, the connection bracket is in the walking-assistance orientation.

17. The walker apparatus as claimed in claim 16, wherein the second bracket connection portion is located between the first bracket connection portion and the bracket pivot portion, and the first pushrod length is shorter than the second pushrod length.

* * * * *